United States Patent [19]

Horiuchi

[11] Patent Number: 4,694,940

[45] Date of Patent: Sep. 22, 1987

[54] CARRYING CASE WITH A HINGED LID AND CLOSURE MEMBER

[76] Inventor: Yutaka Horiuchi, Apt. 910, 100-8th Avenue, Kitchener, Ontario, Canada, N2C 1S3

[21] Appl. No.: 837,071

[22] Filed: Mar. 6, 1986

[51] Int. Cl.[4] ..... A45C 3/02; A45C 13/10; A45C 15/02

[52] U.S. Cl. ..... 190/109; 190/119; 190/900

[58] Field of Search ..... 190/1, 11, 100, 109, 190/111, 112, 114, 119, 13 E, 900; 312/244; 108/44; 150/52 B

[56] References Cited

U.S. PATENT DOCUMENTS

| | | | |
|---|---|---|---|
| 722,317 | 3/1903 | Moody | 190/119 |
| 1,319,761 | 10/1919 | Davis | 190/13 E |
| 1,610,146 | 12/1926 | Panzer | 190/109 |
| 1,628,812 | 5/1927 | Shwayder | 190/109 |
| 2,213,821 | 9/1940 | McCurdy | 190/119 X |
| 2,438,780 | 3/1948 | Hochner | 190/112 X |
| 3,408,126 | 10/1968 | Mortensen | 312/244 X |
| 4,336,883 | 6/1982 | Krug et al. | 190/119 X |

FOREIGN PATENT DOCUMENTS

| | | | |
|---|---|---|---|
| 2384423 | 11/1978 | France | 190/109 |
| 145977 | 7/1920 | United Kingdom | 190/109 |
| 163059 | 5/1921 | United Kingdom | 190/100 |
| 404825 | 1/1934 | United Kingdom | 190/109 |
| 1555056 | 11/1979 | United Kingdom | 190/109 |

*Primary Examiner*—Stephen Marcus
*Assistant Examiner*—Sue A. Weaver
*Attorney, Agent, or Firm*—Anthony Asquith & Co.

[57] ABSTRACT

The carrying case disclosed is of the attache-case variety. It includes a tray (3)located under the lid (2) of the case. The tray overlies, and closes, the compartment (14) in the body (1) of the case when the lid of case is un-zipped and raised. The tray (3) can be used as a writing tablet (7). The tray (3) includes a flap (8) that is hinge-able relative to the remainder (7) of the tray. The flap (8) can be raised to allow restricted access to the compartment (14). Alternatively, the whole tray (3) can be raised to permit wide-open access to the compartment (14). The lid (2) of the case is provided with a corresponding hinged flap (21). The tray (3) rests on top of the inner frame (5) of the body (1) of the case.

5 Claims, 9 Drawing Figures

CARRYING CASE WITH A HINGED LID AND CLOSURE MEMBER

This invention relates to carrying cases, such as document-carrying cases.

BACKGROUND TO THE INVENTION

Document or business cases may be categorized into two types: the traditional briefcase, which opens only at one edge, and permits papers etc. to be inserted only edge-wise, and the attache-case, which opens completely, like a suitcase.

The attache-case is now the more fashionable, but the attache-case does suffer from one drawback—the drawback lies in the fact that the interior compartment of the case is so very accessible when the attache-case is opened, in that it is impossible to keep the contents of the case hidden when the case is open.

Many businessmen therefore are reluctant to use an attache-case at a conference table, or while working on a train or aircraft.

The businessmen on that basis prefer the traditional briefcase which does at least keep its contents hidden. Its disadvantage is that it keeps them always hidden.

The invention is aimed at providing a carrying case which can keep its contents hidden, like a briefcase, but which can provide wide-open access, like an attache-case.

GENERAL DESCRIPTION OF THE INVENTION

In the invention, the case has a body which defines an interior compartment. The case also has a closure member, which is openable relative to the body in such a manner that when the closure member is opened, the compartment is wide open and highly accessible, in the manner of an attache-case.

In the invention, the closure member includes a flap. The flap is independently openable relative to the body, so that the flap portion of the closure member may be opened when the rest of the closure member is closed. The flap occupies only a minor portion of the whole closure member and is dimensioned to give only a restricted access into the compartment when the flap is open, in the manner of the traditional briefcase.

Thus, the carrying case of the invention, by virtue of the flap in the closure member, may be set like an attache case, with the compartment wide open, or it may be set like a traditional briefcase, with the contents of the case restrictedly accessible and hidden from view.

DETAILED DESCRIPTION OF PREFERRED EMBODIMENT OF THE INVENTION

An example of a case which embodies the invention is shown in the drawings.

Figure 6:
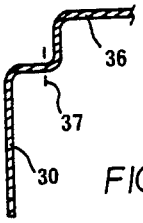
FIG. 6 is a cross-section of the component of FIG. 5.
Figure 7:
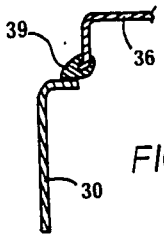

FIG. 7 corresponds to FIG. 6, and shows a different stage in the assembly of the case.

The case shown in the drawings comprises a body 1, a lid 2, and closure member in the form of a tray 3. The lid 2 is hinged to the body 1 by means of a hinge-band 4.

The body 1 and lid 2 are of conventional construction. As shown, the body 1 includes an inner stiffening frame 5 and an outer stiffening frame 6, but the particular manner of constructing the body and lid is not important to the invention. The body might, for example, be made as a onepiece moulding in plastic material. However, the inner frame 5, when an inner frame is present, can be arranged to provide an abutment which is useful in the invention as will be explained presently.

The case includes the tray 3. The tray 3 is a unitary or one-piece component which is vacuum-formed out of sheet plastic material. The tray 3 includes a main-portion or tablet 7, a flap-portion 8, and a lug-portion 9. Each of these three portions 7, 8, 9 is rigid in itself, and the tray 3 is provided with two hinges 10, 11 so that the portions 7, 8, 9 can articulate relatively, as shown. The hinges 10, 11 lie parallel to the hinge that is defined and provided by the hinge-band 4.

The hinges 10, 11 are of the "living hinge" kind, in that the hinges 10, 11 are formed integrally into the material, by making the material locally thinner along a creaseline. The thinning can be performed by melting the material locally, or by cutting a groove in the material. A living hinge is not as a general rule regarded as being reliable over a long service life, because there is a tendency for a tear to start at the crease. It is recognised in the invention that a living hinge is acceptable, because the arcuate movement at the hinge is required to be only a few degrees.

Figure 3:
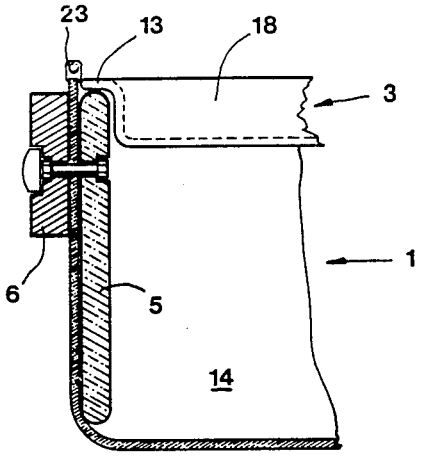
FIG. 3 is a cross-section at a side-wall of the case.

The tray 3 is formed all round with a lip 13, which rests on the abutment provided by the inner frame 5 (FIG. 3), as referred to above.

Figure 1A:
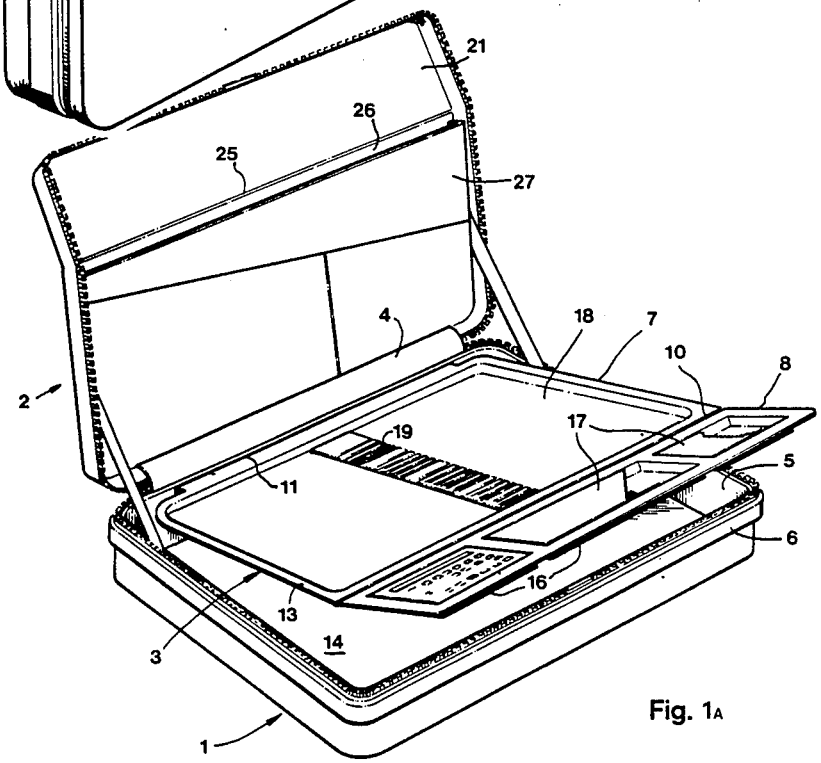
FIG. 1A is a pictorial view of the case, which shows the closure member in the almost fully open position.
Figure 1B:
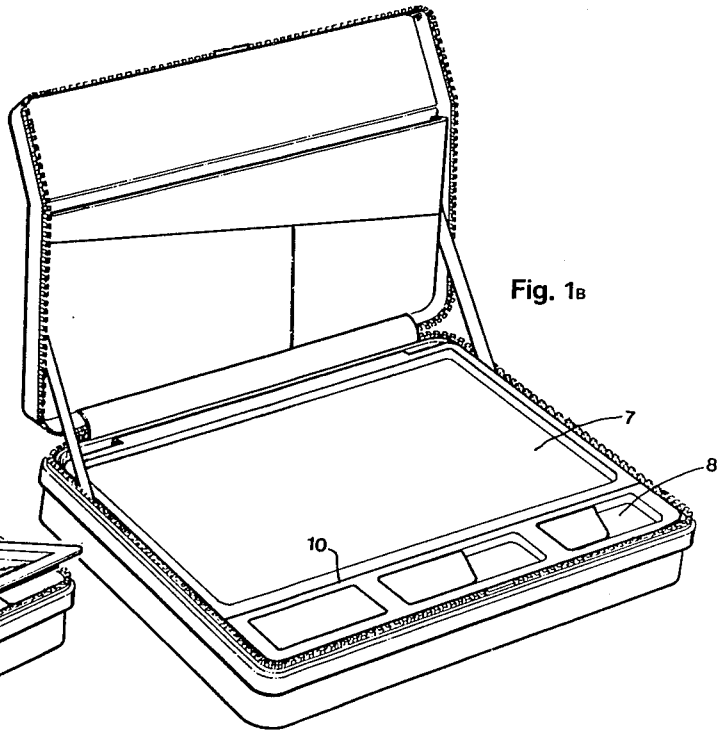
FIG. 1B is a corresponding view to FIG. 1A, but shows the closure member in the fully closed position.

The tray 3 may take up one of three positions. First (FIG. 1B) the tray 3 may be closed. Here, the tablet 7 and the flap 8 are both resting with the lip 13 on the innerframe 5. The compartment 14, defined by the body 1, is now fully closed and inaccessible.

In the second position (FIG. 1A) the tray 3 is open. Now, the lip 13 is well clear of the inner frame 5, and the compartment 14 is fully open and accessible.

Figure 1C:
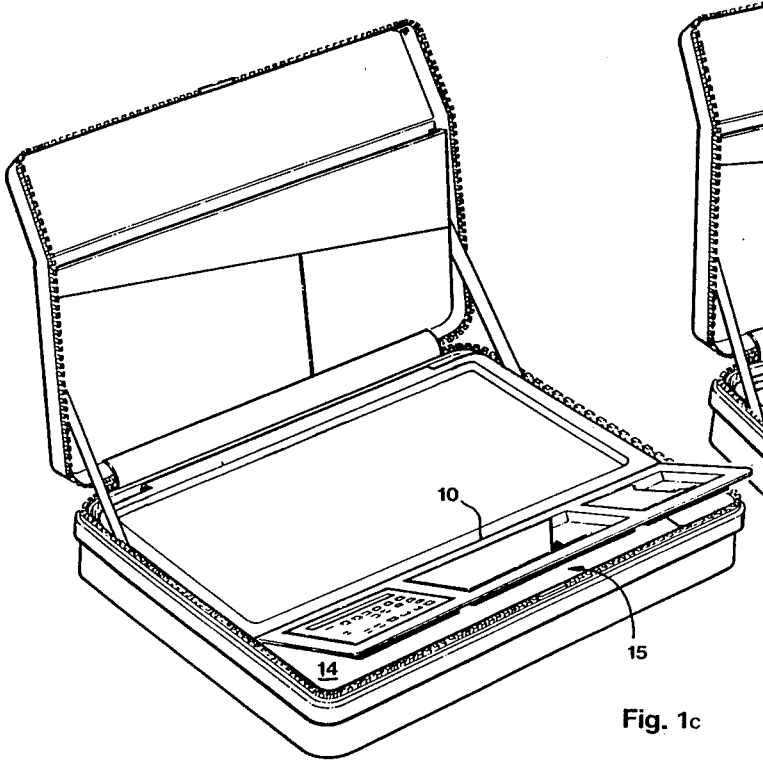
FIG. 1C is a corresponding view to FIG. 1A, but shows the closure member in a partly-open position.

In the third position (FIG. 1C) the tray 3 is in a partly-open position. Here, the tablet 7 is closed down onto the inner frame 5, but the flap 8 has been raised, by pivoting the flap 8 about the hinge 10. The flap 8 is so dimensioned that a person's hand can be inserted into the gap 15 thus produced, to gain access to the compartment 14. This access through the gap 15 is not of course as complete as the access provided when the tray 3 is in the fully open position, but the restricted access is nevertheless quite adequate for checking the contents of the compartment 14, and for withdrawing papers occasionally. It will be noted that when the tray 3 is in the partly open position, the contents of the compartment 14 are well hidden.

The shape and size of the tray 3 as shown is such that when the tray 3 is in the closed (FIG. 1B) position the tray completely covers the compartment 14. It is recognised in the invention that sometimes it is not necessary for the tray to completely cover the compartment. The tray might, for example, be somewhat narrower than the compartment, and yet such a tray, when closed, could still act to retain and to mask the contents of the compartment.

The flap portion 8 of the illustrated tray 3 has been provided with wells 16 for the purpose of receiving a calculator, pens and pencils, business cards, or other appropriate articles. The wells 16, as shown, have been provided with snap-in or glued-in covers 17 to retain the items in the wells.

The tablet 7 has also been formed with a well 18, which is dimensioned to receive a standard-sized pad of paper. An elastic band 19 serves to locate the pad in the well 18. The wells 16, 18 serve to stiffen the tray, which ensures that the tray cannot bend except at the hinges.

Figure 2:
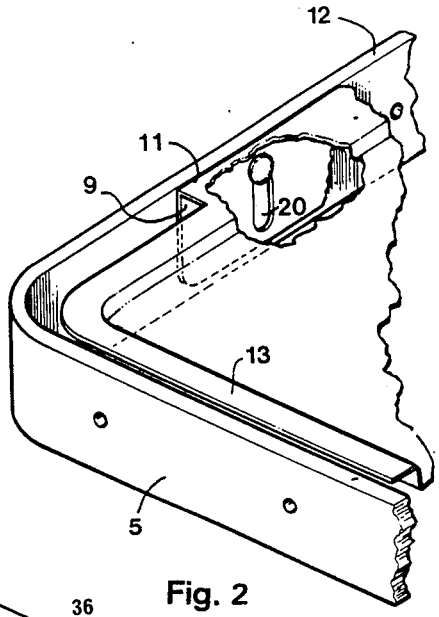
FIG. 2 is a cut-away close-up view of a corner of the case.

The lug 9 is attached to the backwall 12 of the body 1. As shown in FIG. 2 the lug 9 has slots 20 at its attachment point with the back wall 12. The slots 20 permit the tray 3 to rise and remain level if the compartment 14 should be over-filled.

The lid 2 of the illustrated case is also provided with a flap 21. The lid-flap 21 overlies the tray-flap 8. The lid 2 is closed onto the body 1 by means of two zip fasteners 22, 23. These are arranged symmetrically, and it will be noted therefore that the zips may be pulled back so that only the lid-flap 21 is unzipped, while the remainder or main-portion 24 of the lid 2 remains zipped and closed.

The lid-flap 21 of the lid 2 is hinged with respect to the main-portion 24, of the lid 2; the result is that a person may easily take out a business card, for example, from the wells 16 of his case without opening the whole case.

The hinge 25 of the lid-flap 21 may be formed also as a living hinge, or, when the lid is of flexible fabric, as illustrated, the hinge 25 may simply comprise the limit of a stiffening board 26 attached to the lid 2. A pocket 27 may be incorporated also into the lid 2.

Figure 4:
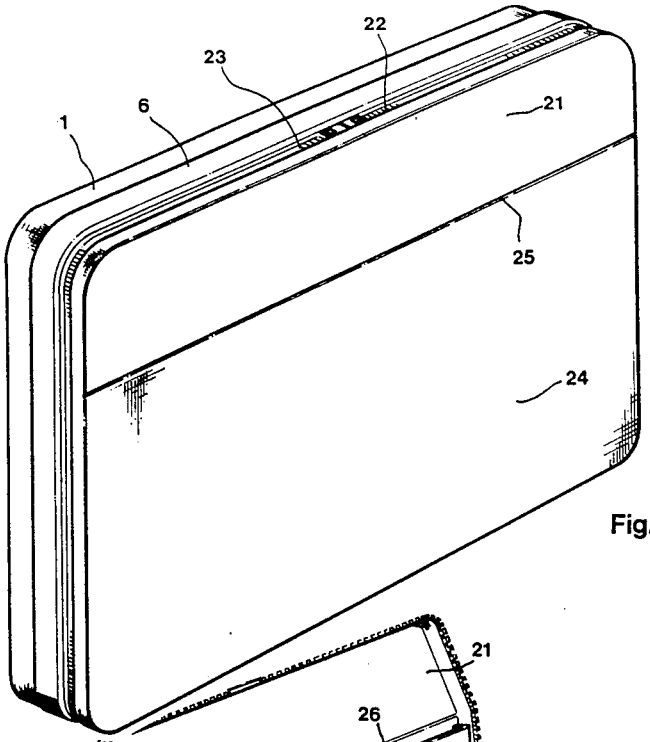
FIG. 4 is a pictorial view of the exterior of the case.

The hinge 25 permits the lid 2 to incorporate an attractive design feature; instead of the lid 2 being a mere flat slab, the hinge 25 divides the lid into two rectangular areas, each of pleasing and harmonious proportions, as shown in FIG. 4.

Figure 5:
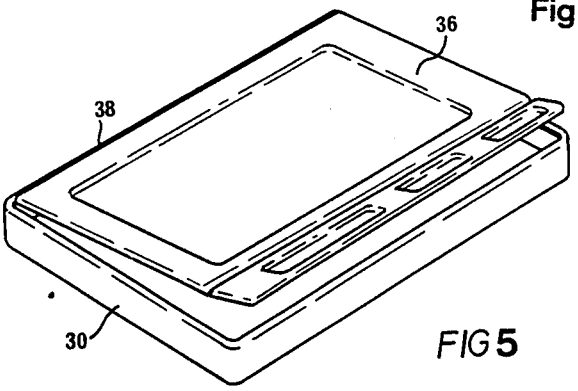
FIG. 5 is a pictorial view of a component of the case, made in an alternative manner.

FIG. 5 illustrates another manner of arranging the closure member. Here, the inner frame 30 and the tray 36 are formed together from a single piece of sheet plastic material, by vacuum forming. The tray 36 is then sheared at 37 (FIG. 6) from the frame 30, except that the back edge of the tray 36 is left attached to the back wall of the frame 30 by means of a living hinge 38. A trim strip 39 (FIG. 7) can be added around the edge of the tray 36, so that the tray 36 may rest on top of the frame 30 when the tray is in the closed position.

The inner frame and tray can be very inexpensive when made in this manner. Also, the resulting construction is light in weight, yet it is adequately rigid because the bent-over edges of the frame 30 and tray 36 act as stiffeners.

Although the carrying case that has been described and illustrated is a businessman's portfolio the invention is applicable to other kinds of carrying case. The basic feature of the invention is the closure-member with its movable flap, which permits a choice of either wide-open acccess or restricted access to the compartment below. This feature is useful not only in briefcases, but also in sports bags, and in luggage generally.

I claim:

1. A carrying case, which comprises a body (1) and a closure member (3);

where the body includes a well-shaped compartment (14) in the body;

characterized in that:

the closure member (3) includes a main-portion (7) and a flap-portion (8), the portions being connected by a connecting means (10) which permits relative movement therebetween;

the flap-portion (8) is smaller than the main-portion (7); the main-portion (7) is rigid;

and the closure member (3) can be set selectably to all these positions relative to the body:

(a) a closed position, in which the said two portions (7, 8) of the closure member (3) lie over respective parts of the well-shaped compartment (14), the closure member (3) being so shaped and dimensioned as to substantially close at least a major part of the well-shaped compartment (14) when set in the closed position;

(b) a wide-open position, in which both portions (7, 8) are displaced away from the well-shaped compartment (14), leaving the well-shaped compartment wide open;

(c) and a partially-open position where the main-portion (7) lies over, and substantially closes, a part of the well-shaped compartment (14), and where, simultaneously, the flap-portion (8) lies open enough relative to the body (1) to permit access into the wall-shaped compartment;

where the case is provided with a lid (2), where the lid is separate from the closure member (3), and where the lid is attached to a back wall (12) of the body (1) and is pivotable relative to the back wall (12);

where the lid (2) includes a lid-flap-portion (21) and a lid-main-portion (24) the portions (21, 24) being connected by a lid-flap-connecting-means (25) which permits relative movement therebetween;

where the lid (2) can be set selectably to all these positions relative to the body (1):

(a) a closed position, in which the said two portions (21,24) of the lid (2) lie over the corresponding portions (8,7) of the closure member (3);

(b) a wide-open position, in which both portions (21, 24) of the lid are displaced away from the closure member (3), leaving the closure member, in substance, wide open;

(c) and a partially-open position, where the lid-main-portion (24) lies over, and substantially closes, the main-portion (7) of the closure member (3), and where simultaneously the lid-flap-portion (21) lies open enough relative to the closure-member (3) to permit access into the lid-flap-portion (21).

2. Case of claim 15, where the lid (2) is secure-able to the body (1) by means of a zip fastener (22, 23) and where the zip fastener (22, 23) is so arranged that the lid-flap-portion (21) is movable to the said partially-open position at the same time as the lid-main-portion (24) remains secured to the body (1) by the zip fastener (22, 23).

3. Carrying case, which comprises a body (1) and a closure member (3);

where the body includes a well-shaped compartment (14) in the body;

characterized in that:

the closure member (3) includes a main-portion (7) and a flap-portion (8), the portions being connected by a connecting means (10) which permits relative movement therebetween;

the flap-portion (8) is smaller than the main-portion (7);

the main-portion (7) is rigid;

and the closure member (3) can be set selectably to all these positions relative to the body:

(a) a closed position, in which the said two portions (7,8) of the closure member (3) lie over respective parts of the well-shaped compartment (14), the closure member (3) being so shaped and dimensioned as to substantially close at least a major part of the well-shaped compartment (14) when set in the closed position;

(b) a wide-open position, in which both portions (7, 8) are displaced away from the well-shaped compartment (14), leaving the well-shaped compartment wide open;

(c) and a partially-open position where the main-portion (7) lies over, and substantially closes, a part of the well-shaped compartment (14), and where, simultaneously, the flap-portion (8) lies open enough relative to the body (1) to permit access into the well-shaped compartment;

where the case is provided with a lid (2), where the lid is separate from the closure member (3), and where the lid is attached to a back wall (12) of the body (1) and is pivotable relative to the back wall (12);

and where the main portion comprises a tablet (7) and includes a paper-retaining-well (18), which is so dimensioned as to receive snugly a pad of paper.

4. Carrying case, which comprises a body (1) and a closure member (3);

where the body includes a well-shaped compartment (14) in the body;

characterized in that:

the closure member (3) includes a main-portion (7) and a flap-portion (8), the portions being connected by a connecting means (10) which permits relative movement therebetween;

the flap-portion (8) is smaller than the main-portion (7);

the main-portion (7) is rigid;

and the closure member (3) can be set selectably to all these positions relative to the body:

(a) a closed position, in which the said two portions (7,8) of the closure member (3) lie over respective parts of the well-shaped compartment (14), the closure member (3) being so shaped and dimensioned as to substantially close at least a major part of the well-shaped compartment (14) when set in the closed position;

(b) a wide-open position, in which both portions (7, 8) are displaced away from the well-shaped compartment (14), leaving the well-shaped compartment wide open;

(c) and a partially-open position where the main-portion (7) lies over, and substantially closes, a part of the well-shaped compartment (14), and where, simultaneously, the flap-portion (8) lies open enough relative to the body (1) to permit access into the well-shaped compartment;

where the case is provided with a lid (2), where the lid is separate from the closure member (3), and where the lid is attached to a back wall (12) of the body (1) and is pivotable relative to the back wall (12);

and where the flap-portion (8) includes a loose-article-well (16).

5. Case of claim 4, where the loose-article-well (16) in the flap-portion (8) is provided with a cover (17), which is so dimensioned and disposed as to act as a retainer for loose articles placed in the loose-article-well (16).

* * * * *